United States Patent [19]

Wedertz et al.

[11] Patent Number: 4,708,304

[45] Date of Patent: Nov. 24, 1987

[54] RING-WING

[75] Inventors: Larry D. Wedertz, Mira Loma; Lynn J. Swann, LaVerne, both of Calif.

[73] Assignee: General Dynamics, Pomona Division, Pomona, Calif.

[21] Appl. No.: 813,894

[22] Filed: Dec. 27, 1985

[51] Int. Cl.[4] ..... F42B 13/24

[52] U.S. Cl. ..... 244/3.26; 244/3.28

[58] Field of Search ..... 244/3.26, 3.24, 3.3, 244/3.25, 3.28, 3.29, 3.27

[56] References Cited

U.S. PATENT DOCUMENTS

| | | | |
|---|---|---|---|
| 17,173 | 4/1857 | Sibley | 244/3.26 |
| 20,238 | 10/1905 | Pedersen | 224/3.26 |
| 1,257,126 | 2/1918 | Schneider | 244/3.26 |
| 2,344,957 | 3/1944 | Anzalone | 102/35 |
| 2,409,904 | 10/1946 | Schermuly et al. | 102/50 |
| 2,437,211 | 3/1948 | Schermuly et al. | 102/50 |
| 2,446,110 | 7/1948 | Schermuly et al. | 102/50 |
| 2,752,850 | 7/1956 | Warner et al. | 102/50 |
| 3,125,957 | 3/1964 | Lipinski | 102/50 |
| 3,251,301 | 5/1966 | Herrmann | 102/49 |
| 3,267,854 | 8/1966 | Michelson | 244/3.3 |
| 4,024,998 | 5/1977 | Rabinow et al. | 244/3.26 |

FOREIGN PATENT DOCUMENTS

| | | |
|---|---|---|
| 36611 | 7/1961 | Fed. Rep. of Germany . |
| 8127138 | 9/1981 | United Kingdom . |

*Primary Examiner*—Deborah L. Kyle
*Assistant Examiner*—Michael J. Carone
*Attorney, Agent, or Firm*—Neil F. Martin; Edward B. Johnson

[57] ABSTRACT

A ring-wing assembly for use in combination with a missile or mortar adapted to be launched from a launch tube or barrel allows attachment of large lifting surfaces to the projectile as it is launched from a barrel. The ring-wing assembly generally comprises a stop ramp for generally encircling a missile body. The stop ramp having a forward-tapering ramp portion, and a sleeve assembly comprising a sleeve for encircling a body of a missile and a plurality of wings peripherally mounted on the sleeve. The sleeve has a rear inside tapered portion having a taper angle that is less than that of the ramp portion of the stop ramp. In use, the sleeve assembly is mounted on the nose end of a launch barrel. Upon missile launch, the sleeve assembly slides over the missile body until encountering and engaging with the stop ramp whereupon the sleeve assembly travels with the missile for extending the range and controllability of the missile. An alternate embodiment of the invention for use with a missile having front control surfaces, such as canards, employs a shear ring for retaining the canards in a retracted position while in the barrel. Upon missile launch, the sleeve assembly disengages the shear ring to allow deployment of the canards.

14 Claims, 7 Drawing Figures

RING-WING

BACKGROUND OF THE INVENTION

1. Field of the Invention

This invention relates in general to wings for a missile or mortar projectile, and more specifically involves a rigid, ring-wing assembly for attachment to a barrel-launched projectile.

2. Background of the Invention

In many instances it is desirable to launch a missile or mortar round from a barrel or launch-tube. A major disadvantage of barrel-launching is that it restricts the use of lift-enhancing wings for extending the range and controllability of the projectile. Conventionally, wings on a barrel-launched projectile are erectable. They are held in a retracted position within the missile body and erected after launch.

There are several problems associated with using large erectable wings for this purpose. Large wings, when retracted, take up valuable space within the missile body which thereby needlessly increase the size and aerodymanic drag of the missile within the missile body during launch, after erection, and while in flight. Additionally, there are the mechanical problems associated with erecting a wing and the likelihood of failure of the wing to properly deploy. Also, large erectable wings used as lifting surfaces are often of flexible material which has unstable flight characteristics at certain velocities.

Therefore, it is desirable to have a means for attaching large wing surfaces to a tube launched projectile to increase the range and controllability of the projectile.

It is further desirable that such wings be rigid to provide stability through various flight velocities.

SUMMARY OF THE INVENTION

This invention is a ring-wing assembly for use in combination with a missile adapted to be launched from a barrel, and a launch barrel. The ring-wing assembly generally comprises a wing flange for generally encircling a missile body and having a forward-tapering ramp portion, and a sleeve assembly generally comprising a sleeve for encircling the body of a missile and a plurality of wings peripherally mounted on the sleeve.

According the the invention, the sleeve has a rear inside tapered portion having a taper angle that is less than that of the ramp portion of the wing flange.

In use the wing flange is attached to the body of a tube-launched missile and the sleeve assembly is mounted on the nose end of the launch barrel. A missile, upon launch, passes thru the sleeve assembly until the ramp portion of the wing flange encounters and engages with the sleeve assembly whereupon the sleeve assembly travels with the missile to provide larger lifting surfaces for increased missile range and maneuverability.

The differing taper angles of the sleeve and ramp portion allow for progressive, shock-reducing engagement and for an interference fit between these members.

According to a further precept, the invention, in combination with a barrel-launched missile having control surfaces, includes means for aligning the position of the wings relative to the control surfaces. This is accomplished by aligning the missile and sleeve assembly to the barrel. The missile is aligned to the barrel thru a protrusion or pin on the periphery of the wing flange or missile rear flange which engages a slot or channel in the inside wall of the barrel.

According to an alternate embodiment of the invention, for use in combination with a controllable missile having retracted forward control surfaces, a shear ring encircles the body of a missile and retains erectable front control surfaces such as canards in a retracted position. Upon launch, the shear ring encounters the sleeve assembly. The shock encounter disengages the shear ring from its control surface retaining position and the engaged sleeve assembly and shear ring slide over the missile body until encountering the ramp portion of a rear flange.

Other features and many attendant advantage of the invention will become more apparent upon a reading of the following detailed description together with the drawings, wherein like reference numerals refer to like parts throughout.

DETAILED DESCRIPTION OF THE INVENTION

Figure 1:
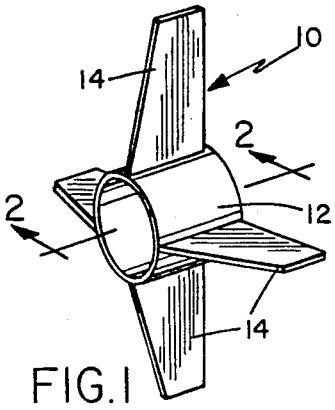
FIG. 1 is a perspective view of preferred embodiment of the ring-wing assembly of the present invention.

With reference now to the drawing, there is shown a ring-wing assembly for use in combination with a missile 40 adapted to be launched from a barrel 30. The ring-wing assembly generally comprises: a sleeve assembly 10 and wing flange 46 and may include shear ring 70. With reference now particularly to FIG. 1 of the drawing, there is shown a sleeve assembly, designated generally as 10, of the ring-wing assembly of the present invention. The sleeve assembly 10 generally comprises a cylindrical sleeve 12 and a plurality of wings 14 peripherally mounted thereon. The inside diameter of sleeve 12 is designed to slip over the outside surface of a missile. The sleeve 12 and wings 14 are preferably of a high-strength but light-weight material suitable for providing the major lifting function for a missile.

Figure 2:
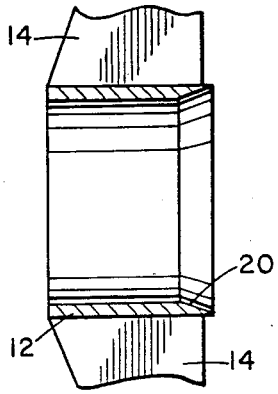
FIG. 2 is an enlarged sectional view taken on line 2—2 of FIG. 1.
Figure 3:
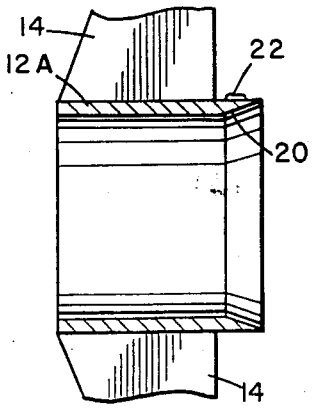
FIG. 3 is an enlarged sectional view similar to FIG. 2 of an alternate embodiment.

FIGS. 2 and 3 illustrate alternative embodiments of the sleeve assembly. FIG. 2 is an enlarged sectional view taken on line 2—2 of FIG. 1. As seen in FIG. 2, sleeve 12 has a rear inside tapered portion 20 which is generally flush with the rear edge of wings 14. FIG. 3 shows an alternate embodiment in which the inside rear tapered portion of sleeve 12A projects rearwardly of wings 14.

Figure 4:
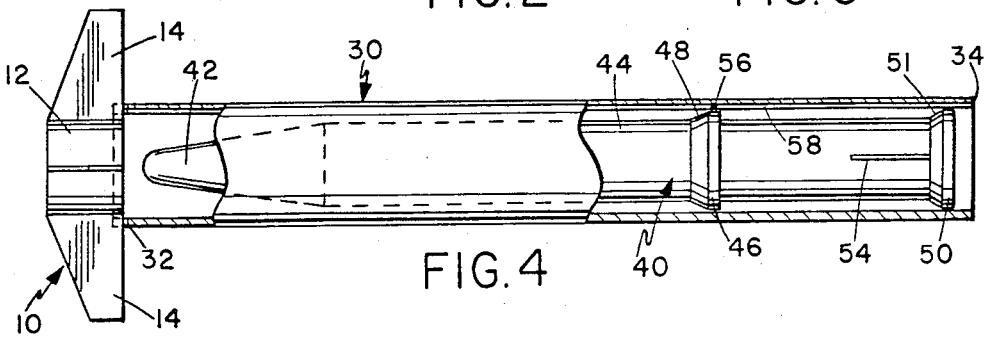
FIG. 4 is a side elevation view, with portions cut away of a missile in a launch barrel with a sleeve assembly mounted on the nose end of the launch barrel.

FIGS. 3 and 4 illustrate the ring-wing assembly in combination with a projectile, such as missile 40 adapted to be launched from a launch barrel 30. Missile 40 comprises a generally elongated cylindrical body 44 having a longitudinal axis, a nose portion 42, a rear portion, rear flange 50, and flight control means, such as controllable fins 52. In order to fit in a launch barrel 30, controllable fins 52 must be stowed in the missile 40. In the embodiment show here, the fins 52 are stowed in slots 54 in the missile body 44 and deployed after launch for controlling the missile in flight. The ring-wing assembly includes a stop-ramp means, such as ring flange 46, which generally encircles the missile body 44 and is attached thereto. The periphery of wing flange 46 generally engages the inside walls of launch barrel 30 and centers and stabilizes the missile 40 in the barrel. Wing flange 46 includes a forward-tapering ramp portion 48. The taper angle of ramp portion 48 is greater than that of the rear inside tapered portion 20 of sleeve 12.

In use, the sleeve assembly 10, including the sleeve 12 and wings 14, is mounted on the nose end of launch barrel 30 by suitable means. As shown in FIG. 4, the nose end of barrel 30 may have notches cut therein for accepting the wings 14, or the barrel could include projections to engage the sleeve assembly 10. Suitable holding means, such as small shear pins or press-fit brackets, positively retain the sleeve assembly 10 on the nose end of launch barrel 30. Alternatively, an extended rear sleeve portion as shown in FIG. 3, allows the sleeve assembly 10 to be fitted partially within the end of barrel 30.

Detent means, such as ridge 22 positively engages an indentation within the barrel for retaining the sleeve assembly in proper mounted position at the nose end of the launch barrel.

Figure 5:
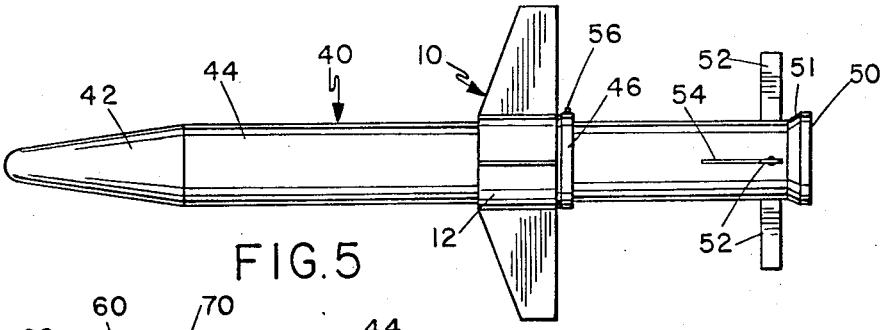
FIG. 5 is a side elevation view of a missile with the ring-wing assembly in flight position.
Figure 7:
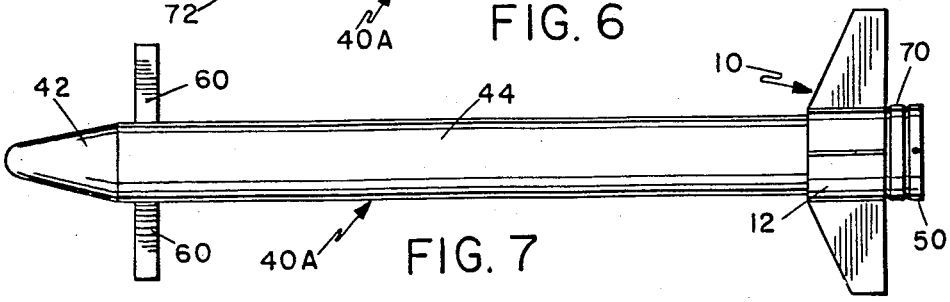
FIG. 7 is a side elevation view of an erectable canard controlled missile with the sleeve assembly and shear wing engaged with the rear stop in flight.

Often, specific alignment of the wings 14 relative to the control fins 52 is desired. For example, the wings 14 may be in direct alignment with the control fins 52, as illustrated in FIGS. 5 and 7. In many instances it has been found that this direct alignment produces undesirable turbulence on the trailing wing or control surface, and therefore, the wings 14 should be offset from the control fins by as much as possible. With four wings and four control fins as illustrated in the drawing, the wings 14, may be preferably offset 45 degrees from the control fins 52. To achieve a fixed relative alignment of wings to control fins 52, both the missile 40 and the sleeve-assembly 10 are aligned to launch barrel 30. The missile alignment means may include pin 56 mounted on the periphery of wing flange 46 or rear flange 50 and groove 58 in the inner wall of barrel 30. The sleeve assembly 10 is indexed relative to the barrel 30 by any of various methods depending upon the mounting method used. The sleeve assembly 10 may be indexed relative to the barrel with wing-retaining brackets or notches as shown in FIG. 4, or the detent means, ridge 22, may include an indexing detent means for mating with a mating slot or ridge in the launch barrel.

The inside diameter of sleeve 12 is dimensioned to slide over the outside diameter of missile body 44. Thus, upon launch, missile 40 passes through the sleeve assembly 10 whereby wing flange 56 encounters and engages sleeve-assembly 10 and causes it to travel with a missile. The taper angle of ramp portion 48 is greater than that of the rear inside tapered portion 20 of sleeve 12. This difference in the taper angles of the rear inside tapered portion 20 of sleeve 12 and stop ramp 48 provides for progressive, shock-reducing engagement and for an interference fit of the sleeve assembly 10 with the wing flange 46.

In this manner, a barrel-launched missile may be fitted with large range-extending and control-enhancing wings.

Figure 6:
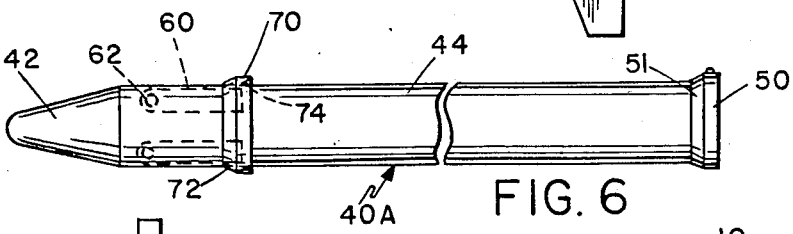
FIG. 6 is a side elevation of an alternative embodiment of the ring-wing assembly including a shear ring for retaining erectable canard control surfaces for a controlled missile.

FIGS. 6 and 7 illustrate an alternate preferred embodiment of the wing-ring assembly of the present invention specifically adapted for use with a missile 40A having forward flight control means, such as controllable canards 60. Canards 60 are retractable and fit in slots in the missile body 44 and deploy in flight after the missile 40A has left barrel 30. Typically a biasing means, such as a spring, not shown, moves the canard 60 to the open position as shown in FIG. 7. In this configuration, the ring-wing assembly includes a shear ring 70. The shear ring 70 generally encircles the missile body 44 and retains the erectable control canards 60 in a retracted position. The periphery of shear ring 70 bears against the inside surface of launch tube 30 to center missile 40 in the barrel during launch. The shear ring 70 has a rear intertapered portion 74 and a ramp front portion 72.

Upon launch, the missile 40A passes through the sleeve assembly whereby the sleeve assembly 10 encounters and engages the shear ring 70. The force of encounter disengages the shear ring 70 from its control surface retaining position and the engaged sleeve assembly 10 and shear ring 70 slide over missile body 44 until the shear ring 70 encounters and engages the ramp portion 51 of rear flange 50. Shear ring 70 may be constructed of resilient or deformable material for shock absorption. The taper angles on the mating surfaces between sleeve assembly 10, shear-ring 70, and rear flange 70 operate as described above in that the angle of the overlapping rear intertapered portions is less than that of the forward facing ramp portions for progressive, impact-lessening engagement and for a pressure fit.

From the foregoing description, it is seen that the present invention provides an extremely simple and reliable manner of providing a barrel-launched missile with large wings for improved lift, increased range, and controllability.

Although particular embodiments of the invention have been illustrated and described, modifications and changes will be apparent to those skilled in the art, and it is intended to cover in the appended claims such modifications and changes as come within the true spirit and scope of the invention.

Having described our invention, we now claim:

1. A ring-wing assembly for extending the range and controllability of a missile, in combination with a missile adapted to be launched from a barrel, said barrel having a nose and; said missile comprising a generally elongated cylindrical body having a longitudinal axis, a nose portion, and a rear portion; said ring-wing assembly comprising:

stop ramp means for generally encircling a missile body, said stop ramp means having a forward-tapering ramp portion; and a sleeve assembly comprising:

a sleeve for encircling the body of a missile; said sleeve comprising:

a substantially smooth rear inside tapered portion having a taper angle that is less than that of the ramp portion of said stop ramp means for progressive, shock-reducing engagement and for an interference fit with said ramp portion; and a plurality of wings peripherally mounted on said sleeve; said sleeve assembly for initial mounting at the nose end of a launch barrel such that a missile upon launch passes through said sleeve assembly until said ramp portion encounters and engages with said sleeve assembly, whereupon said sleeve assembly travels with the missile.

2. The ring-wing assembly of claim 1 wherein said stop-ramp means includes:

centering means for centering a missile in a launch barrel.

3. The ring-wing assembly of claim 1 wherein said sleeve-assembly further comprises:

mounting means for mounting said sleeve assembly at the nose end of a launch barrel.

4. The ring-wing assembly of claim 3 wherein said mounting means comprises:

an extended rear peripheral portion of said sleeve for fitting into a launch barrel for bearing against the inside of a launch barrel.

5. The ring-wing assembly of claim 4 wherein said extending mounted portion of said sleeve comprises:

detent means for positively engaging the inside of a launch barrel.

6. A ring-wing assembly for extending the range and controllability of a controllable missile, in combination with a controllable missile adapted to be launched from a barrel, said barrel having a nose end; said missile comprising a generally elongated cylindrical body having a longitudinal axis, a nose portion, a rear portion, and erectable control surfaces which are in a retracted position in a launch barrel; said ring-assembly comprising:

stop-ramp means for generally encircling a missile body; said stop-ramp means having a forward-tapering ramp portion;

shear-ring means for generally encircling the body of a missile, for retaining erectable control surfaces in a retracted position; said shear-ring means having a rear inside tapered portion having a taper angle that is less than that of the ramp portion of said stop-ramp means for progressive, shock-reducing engagement with said stop-ramp means; a sleeve-assembly comprising:

a sleeve for encircling the body of a missile; and a plurality of wings peripherally mounted on said sleeve; said sleeve-assembly for initial mounting at the nose end of a launch barrel such that a missile upon launch passes through said sleeve-assembly, so that said sleeve-assembly engages said shear-ring means and disengages said shear-ring means from a control surface retaining position, and said engaged sleeve-assembly and shear-ring slide over the missile body, said rear inside tapered portion of said shear-ring means progressively encounters and engages said ramp portion of said stop-ramps means whereupon said sleeve-assembly and said shear-ring travel with the missile.

7. The ring-wing assembly of claim 6 wherein said shear-ring means includes:

centering means for centering a missile within a launch barrel.

8. The ring-wing assembly of claim 6 wherein said sleeve-assembly further comprises:

mounting means for mounting said sleeve-assembly at the nose end of a launch barrel.

9. The ring-wing assembly of claim 6 including:

indexing means for mounting on a missile for interaction with a launch tube for maintaining missile control surfaces in a predetermined position relative to a launch tube during missile launch.

10. The ring-wing assembly of claim 6 wherein said shear-means is of resilient, shock absorbant material.

11. The ring-wing assembly of claim 6 wherein said shear-ring means has a forward-tapering ramp portion, and said sleeve has a rear inside tapered portion having a taper angle that is less than that of said ramp portion of said shear-ring means.

12. The ring-wing assembly of claim 8 wherein said mounting means comprises:

an extended rear portion of said sleeve for fitting into a missile launch barrel for bearing against the inside of a launch barrel.

13. The ring-wing assembly of claim 8 wherein said mounting means includes:

sleeve alignment means for positioning the wings in a predetermined position relative to a launch barrel.

14. The ring-wing assembly of claim 12 wherein said extended rear mounting portion of said sleeve comprises:

detent means for engaging the inside of a launch barrel.

* * * * *